US009640895B1

(12) United States Patent
Lyon

(10) Patent No.: US 9,640,895 B1
(45) Date of Patent: May 2, 2017

(54) ELECTRICAL CONNECTOR HAVING A TPA

(71) Applicant: TYCO ELECTRONICS CORPORATION, Berwyn, PA (US)

(72) Inventor: Zachary Wood Lyon, Lewisville, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/181,823

(22) Filed: Jun. 14, 2016

(51) Int. Cl.
*H01R 13/514* (2006.01)
*H01R 13/627* (2006.01)
*H01R 13/426* (2006.01)

(52) U.S. Cl.
CPC ..... *H01R 13/426* (2013.01)

(58) Field of Classification Search
CPC ..... H01R 13/4362; H01R 13/4223; H01R 13/4361; H01R 13/506; H01R 13/4365; H01R 13/4364
USPC ..... 439/752, 595, 352, 357
See application file for complete search history.

(56) References Cited

U.S. PATENT DOCUMENTS 6,913,494 B2 * 7/2005 Ward ..... H01R 13/4365 439/352
7,044,808 B1 * 5/2006 Foltz ..... H01R 13/4362 439/752
7,326,074 B1 * 2/2008 Lim ..... H01R 13/629 439/352
7,549,887 B1 * 6/2009 Ng ..... H01R 13/6272 439/352
9,054,458 B1 * 6/2015 Ng ..... H01R 13/641

* cited by examiner

*Primary Examiner* — Xuong Chung Trans

(57) ABSTRACT

An electrical connector includes a housing having terminal towers extending forward of a base toward a mating end each. The terminal towers are spaced apart by gaps and the gaps define a central cavity between the terminal towers. A TPA device is received in the central cavity and is front loaded into the central cavity through the mating end in a loading direction toward the base. The TPA device includes a plurality of latches received in corresponding terminal towers having latching fingers positionable in terminal channels in blocking positions to block removal of terminals. The TPA device includes a locking block received in the central cavity to lock the TPA device in the central cavity. The locking block is positioned relative to the latches to hold the latches in the blocking positions.

20 Claims, 5 Drawing Sheets

ELECTRICAL CONNECTOR HAVING A TPA

BACKGROUND OF THE INVENTION

The subject matter herein relates generally to terminal position assurance components for electrical connectors.

It is known in various industries to have electrical connectors in the form of plugs and headers to provide electrical connection in such systems as automotive systems, for example, for engine electronics, engine control management systems and the like. At least some known electrical connectors provide terminal position assurance (TPA) devices which assure that the electrical terminal or contact is fully positioned before installing the fully loaded connector assembly into its end application. Such assemblies having TPA devices find substantial utility in automotive use as a terminal or contact which is not fully loaded in the connector, can cause an open circuit in an automotive harness. This in turn can cause substantial cost and effort to isolate and fix the problem.

Known TPA devices are normally insertable into the electrical connector housing from the side to a position where it lies adjacent to a terminal latching device and which can only be fully inserted if the terminal itself is fully inserted, and when the terminal latch within the housing is in its terminal locked position. The side loaded TPA devices create potentially problematic open areas in the housing because of the side access. The open areas allow for tooling flash, water ingress, dust/dirt ingress and other problematic environmental influences on the functionality and reliability of the product.

BRIEF DESCRIPTION OF THE INVENTION

In one embodiment, an electrical connector is provided including a housing having a mating end at a front of the housing and a base at a rear of the housing. The housing has a plurality of terminal towers extending forward of the base toward the mating end. Each terminal tower has a terminal channel therein configured to receive a corresponding terminal therein. The terminal towers are spaced apart from each other by gaps and the gaps define a central cavity between the plurality of terminal towers. A terminal position assurance (TPA) device is received in the central cavity. The TPA device is front loaded into the central cavity through the mating end in a loading direction toward the base. The TPA device includes a plurality of latches received in corresponding terminal towers. The latches have latching fingers positionable in the corresponding terminal channels in blocking positions to block removal of the terminals from the terminal channels. The TPA device includes a locking block received in the central cavity to lock the TPA device in the central cavity. The locking block is positioned relative to the latches to hold the latches in the blocking positions.

In another embodiment, an electrical connector is provided including a housing having a base at a rear of the housing and a shroud extending forward from the base to a mating end at a front of the housing. The shroud encloses a chamber forward of the base. The housing has a plurality of terminal towers extending forward of the base into the chamber. Each terminal tower has a terminal channel therein configured to receive a corresponding terminal therein. The terminal towers are spaced apart from each other by gaps and the gaps define a central cavity between the plurality of terminal towers. The gaps define at least one perimeter cavity between the shroud and corresponding terminal towers. A terminal position assurance (TPA) device is received in the central cavity. The TPA device is front loaded into the central cavity through the mating end in a loading direction toward the base. The TPA device includes an outer frame received in the at least one perimeter cavity between the shroud and the corresponding terminal towers. The TPA device includes a plurality of latches received in corresponding terminal towers. The latches have latching fingers positionable in the corresponding terminal channels in blocking positions to block removal of the terminals from the terminal channels. The TPA device includes a locking block received in the central cavity to lock the TPA device in the central cavity. The locking block is positioned relative to the latches to hold the latches in the blocking positions.

In a further embodiment, a terminal position assurance (TPA) device configured to be operably received in a central cavity of an electrical connector to lock terminals in the electrical connector. The TPA device includes an outer frame defining a perimeter of the TPA device. The outer frame has a front and a rear and a central opening therethrough. The TPA device includes a central plate aligned with the central opening that is connected to the outer frame by straps. The TPA device includes a plurality of latches extending forward from the central plate. The latches are configured to be received in terminal towers holding the terminals. The latches have latching fingers configured to engage and block removal of the terminals. The TPA device includes a locking block coupled to the central plate. The locking block is positioned relative to the latches to hold the latches in blocking positions.

DETAILED DESCRIPTION OF THE INVENTION

Figure 1:
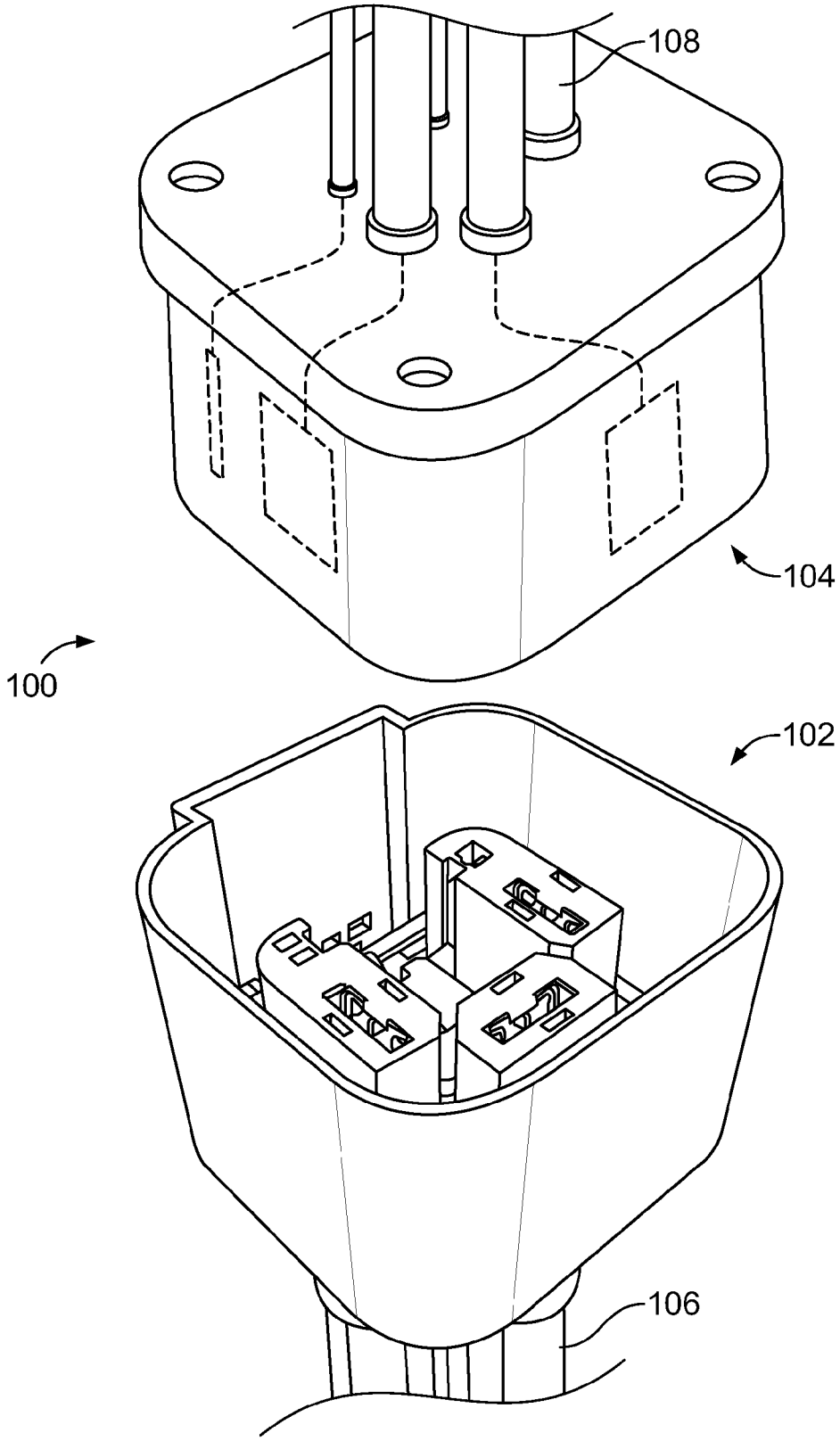
FIG. 1 is a perspective view of a connector assembly formed in accordance with an exemplary embodiment.

FIG. 1 is a perspective view of a connector assembly 100 formed in accordance with an exemplary embodiment. The connector assembly 100 may be configured to be panel mounted to a panel, such as a chassis, bulk head, casing, and the like of a vehicle, machine or structure. The connector assembly 100 is durable and capable of use in rugged or extreme environments. The connector assembly 100 may be used to transmit data and/or power within the vehicle, machine or structure. The connector assembly 100 may be sealed.

The connector assembly 100 includes an electrical connector 102 and a mating connector 104. In an exemplary embodiment, the mating connector 104 is a header connector configured to be mounted to the panel and the electrical connector 102 is a plug connector configured to be mated with the header connector. Optionally, portions of the electrical connector 102 are plugged into the mating connector 104. Optionally, portions of the mating connector 104 are plugged into the electrical connector 102. In an exemplary embodiment, the electrical connector 102 is terminated to one or more cables or wires 106. The mating connector 104 is terminated to one or more cables or wires 108. The wires 106, 108 may be power wires, signal wires, or other types of wires.

Embodiments of the electrical connector 102 described herein provide a terminal positional assurance (TPA) device used to assure that the terminals of the electrical connector 102 are properly positioned and held in the electrical connector 102. Embodiments of the TPA device described herein may provide centralized latching to a plurality of different terminals. Embodiments of the TPA device described herein allow center loading of the TPA device into the housing of the electrical connector 102 through the front or mating end of the housing. Embodiments of the electrical connector 102 eliminate side loading of the TPA device, which may eliminate openings through the side of the housing of the electrical connector 102, which may in turn reduce tooling flash, water or debris ingress, and may reduce the overall size of the electrical connector 102. Embodiments of the electrical connector 102 described herein provide a sealed interface between the electrical connector 102 and the mating connector 104.

Figure 2:
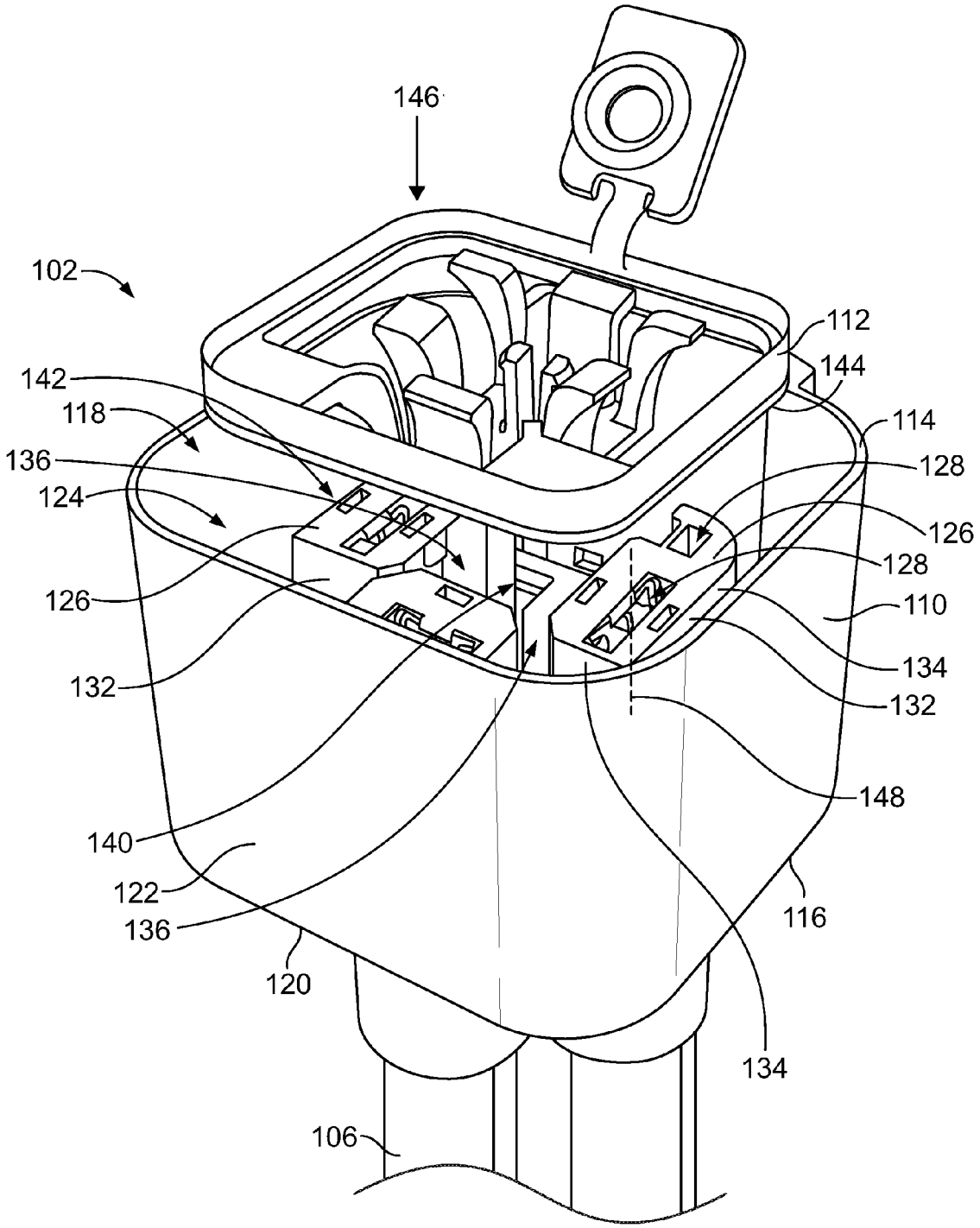
FIG. 2 is an exploded view of an electrical connector of the connector assembly in accordance with an exemplary embodiment.

FIG. 2 is an exploded view of the electrical connector 102 formed in accordance with an exemplary embodiment. The electrical connector 102 includes a housing 110 and a TPA device 112. The housing 110 extends between a front 114 and a rear 116. The front 114 defines a mating end 118 configured to be mated with the mating connector 104 (shown in FIG. 1). The housing 110 includes a base 120 at the rear 116 and a shroud 122 extending forward of the base 120 to the front 114. The shroud 122 defines a chamber 124 forward of the base 120.

The housing 110 includes a plurality of terminal towers 126 extending forward from the base 120 within the chamber 124. The terminal towers 126 each include at least one terminal channel 128 extending therethrough. The terminal channels 128 receive corresponding terminals 130 (shown in FIG. 3), which are configured to be electrically connected to corresponding terminals of the mating connector 104. The terminals 130 are electrically connected to corresponding wires 106. The terminal channels 128 are open at front ends of the terminal towers 126 to receive correspond mating terminals of the mating connector 104. For example, the mating terminals of the mating connector 104 may be pins or blades loaded into the terminal channels 128 for electrical connection with the terminals 130.

The terminal towers 126 include exterior surfaces 132. The exterior surfaces 132 define sides 134 of the terminal towers 126. In the illustrated embodiment, the terminal towers 126 have a generally rectangular or oval cross-sectional shape; however the terminal towers 126 may have other shapes in alternative embodiments, such as cylindrical shapes, oblong shapes, or other shapes. The terminal towers 126 may include any numbers of sides 134. Transitions between the sides 134 may be angular or curved.

In an exemplary embodiment, the exterior surfaces 132 are surrounded by gaps. For example, the gaps 136 may be provided between the terminal towers 126. The gaps 136 may be provided between the terminal towers 126 and the shroud 122. In an exemplary embodiment, the gaps 136 define a central cavity 140 generally centrally located within the chamber 124, such as between the various terminal towers 126. Optionally, each of the terminal towers 126 may be exposed to the central cavity 140. The gaps 136 may define a perimeter cavity 142 around a perimeter of the group of the terminal towers 126. For example, the perimeter cavity 142 may be defined between the shroud 122 and the exterior surfaces 132 of the group of terminal towers 126 that face the shroud 122. Optionally, the perimeter cavity 142 may extend entirely around the terminal towers 126 immediately interior of the shroud 122. Optionally, the chamber 124 may include other cavities in addition to the central cavity 140 and the perimeter cavity 142.

The TPA device 112 is configured to be loaded into the chamber 124. In an exemplary embodiment, a perimeter seal 144 is also loaded into the chamber 124. The perimeter seal 144 is configured to be positioned between the TPA device 112 and the housing 110. For example, the TPA device 112 is loaded into the chamber 124 to hold the perimeter seal 144 against the base 120 to seal the chamber 124. In an exemplary embodiment, the TPA device 112 is sized and shaped to fit in the chamber 124 adjacent the terminal towers 126. For example, a portion of the TPA device 112 may be received in the central cavity 140. A portion of the TPA device 112 may be received in the perimeter cavity 142. The outer perimeter of the TPA device 112 may have a complimentary shape to the interior surface of the shroud 122 such that the TPA device 112 substantially fills the bottom of the chamber 124.

The TPA device 112 is configured to be front loaded into the chamber 124. For example, the TPA device 112 is loaded through the front 114 of the housing 110. The TPA device 112 is loaded in a loading direction 146 that is generally parallel to channel axes 148 of the terminal channels 128. The loading direction 146 is also parallel to the mating direction of the electrical connector 102 with the mating connector 104. In an exemplary embodiment, the shroud 122 does not include any openings along the sides thereof to the chamber 124, but rather is only open at the front 114. As such, the shroud 122 may provide a robust sealed mating with the mating connector 104.

Figure 3:
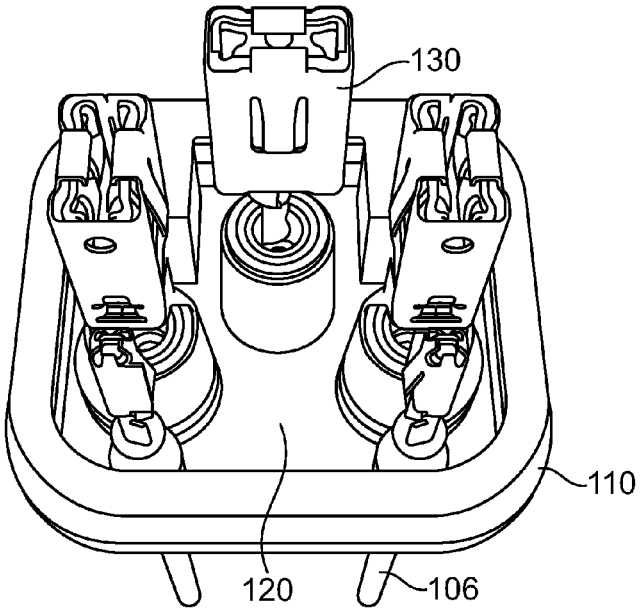
FIG. 3 is a perspective view of a portion of the electrical connector.

FIG. 3 is a perspective view of a portion of the electrical connector 102 with a portion of the housing 110 removed to illustrate the terminals 130. The base 120 is shown in FIG. 3; however the shroud 122 and the terminal towers 126 are removed to illustrate the terminals 130. The terminals 130 are terminated to corresponding wires 106. In the illustrated embodiment, the terminals 130 are sockets configured to receive pins or blades to make an electrical connection with the mating connector 104 (shown in FIG. 1). The terminals 130 and/or wires 106 may pass through the base 120.

Figure 4:
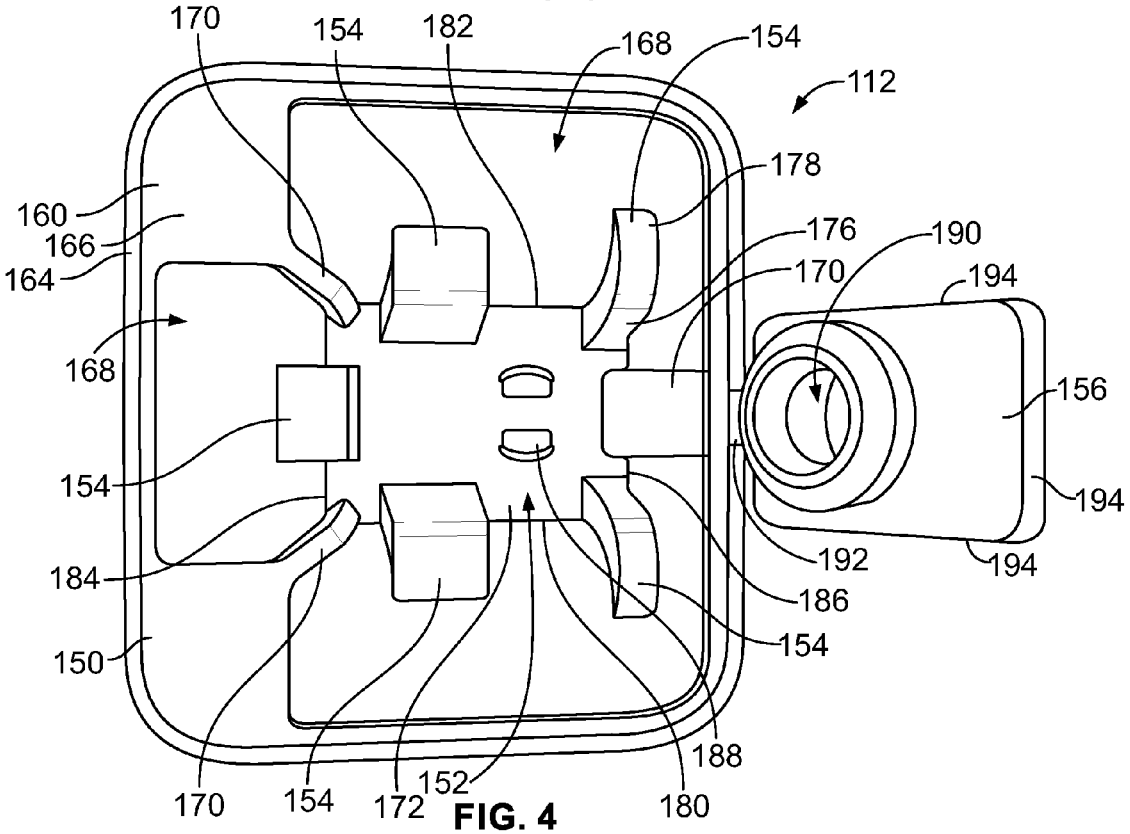
FIG. 4 is a top view of a terminal position assurance (TPA) device of the electrical connector in accordance with an exemplary embodiment.
Figure 5:
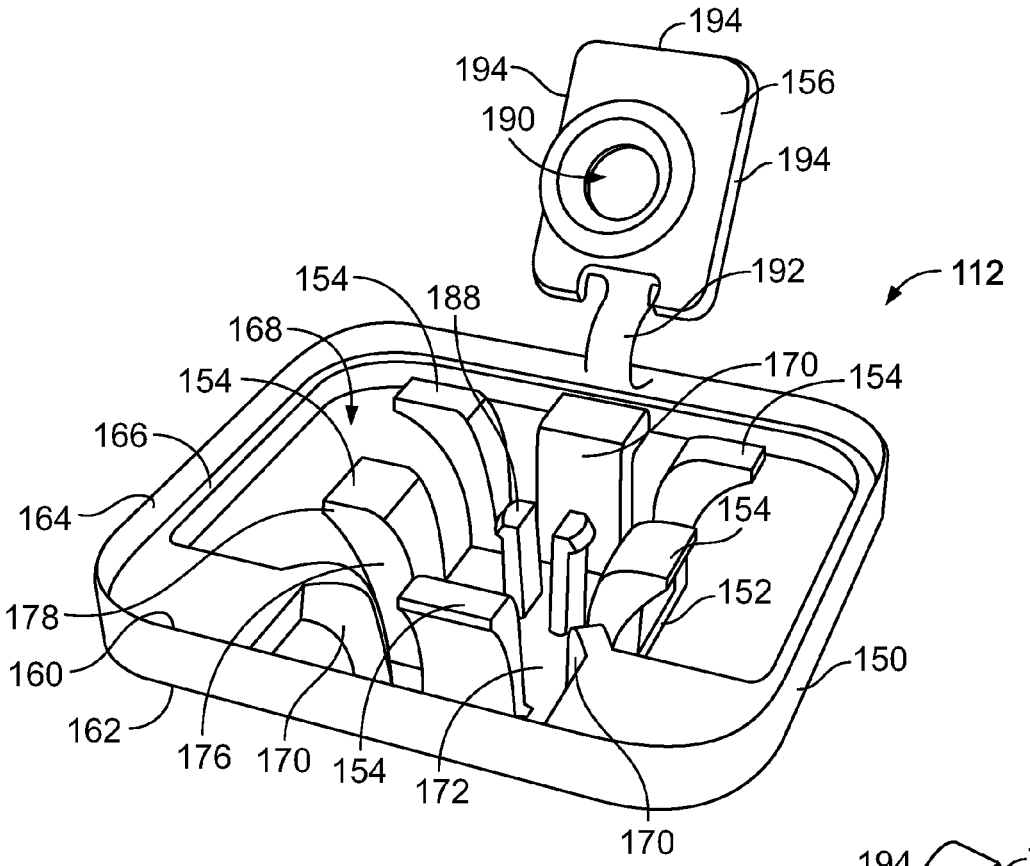
FIG. 5 is a perspective view of the TPA device.
Figure 6:
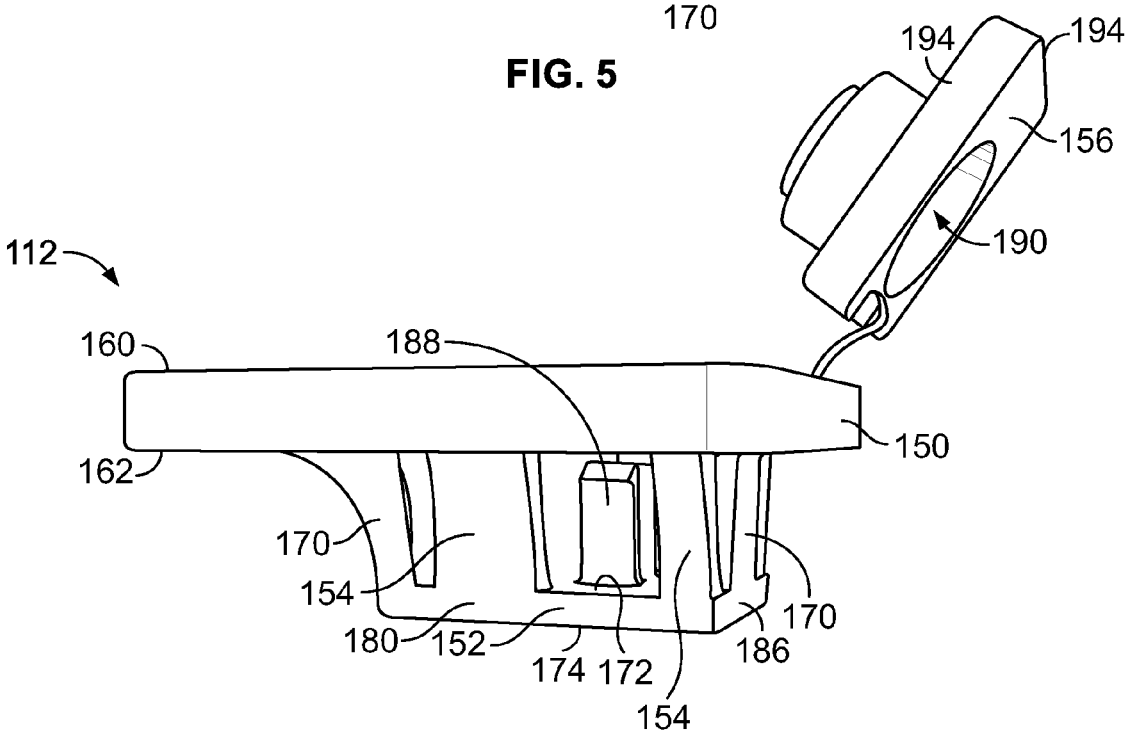
FIG. 6 is a side view of the TPA device.

FIG. 4 is a top view of the TPA device 112 formed in accordance with an exemplary embodiment. FIG. 5 is a perspective view of the TPA device 112. FIG. 6 is a side view of the TPA device 112. The TPA device 112 includes an outer frame 150, a central plate 152, a plurality of latches 154 and a locking block 156. The TPA device 112 may provide centralized latching of the terminals 130 (shown in FIG. 3).

The outer frame 150 defines a perimeter of the TPA device 112. The outer frame 150 has a front 160 and a rear 162 (FIG. 6) opposite the front 160. The rear 162 may define a sealing surface for the perimeter seal 144 (shown in FIG. 2). In an exemplary embodiment, the outer frame 150 includes a rim or lip 164 extending around the perimeter of the outer frame 150. A shoulder 166 may be provided interior of the lip 164. The outer frame 150 includes a central opening 168 therethrough. The central opening 168 may be sized and shaped to receive the terminal towers 126. Optionally, the outer frame 150 may include multiple openings 168.

The central plate 152 is aligned with the central opening 168. The central plate 152 is connected to the outer frame 150 by one or more straps 170. In an exemplary embodiment, the central plate 152 is positioned rearward of the outer frame 150. For example, the straps 170 extend rearward to position the central plate 152 behind the outer frame 150. The central plate 152 is configured to be received in the central cavity 140 (shown in FIG. 2) of the housing 110, such as between the terminal towers 126. The central plate 152 includes a front 172 and a rear 174. The rear 174 may define the rearward most surface of the TPA device 112. The rear 174 may rest on the base 120 (shown in FIG. 2). Optionally, the central plate 152 may be generally planar, such as at the front 172 and/or the rear 174.

The latches 154 extend from the central plate 152. The latches 154 extend forward of the central plate 152. In an exemplary embodiment, the latches 154 are deflectable and are configured to be received in corresponding terminal towers 126 to hold the terminals 130 (shown in FIG. 3) in the terminal towers 126. Each latch 154 includes a latching arm 176 and a latching finger 178 provided at the distal end of the latching arm 176. The latching arm 176 extends forward from the central plate 152. The latching fingers 178 extend outward from the latching arm 176 and are configured to be received in the terminal towers 126 to interact with the terminals 130 (for example, the latching arms 176 may be received in slots or openings in the side of the terminal towers 126). In an exemplary embodiment, the latching fingers 178 each extend outward, away from a central portion of the TPA device 112.

The latches 154 may be provided along multiple sides of the central plate 152. For example, in the illustrated embodiment, two latches 154 are provided along a first side 180 of the central plate 152, two latches 154 are provided along a second side 182 of the central plate 152 opposite the first side 180 and a single latch 154 is provided at a third side 184 extending between the first and second sides 180, 182. Other latches 154 may be provided at other locations in alternative embodiments. As such, the single part (for example, the TPA device 112) is used to provide terminal latching for multiple terminals, even at different, remote locations within the connector. In the illustrated embodiment, the straps 170 extend from the outer frame 150 to the third side 184 of the central plate 152, such as at the corners with the first and second sides 180, 182. Another strap 170 is provided at a fourth side 186 opposite the third side 184. The straps 170 may be provided at other locations in alternative embodiments.

In an exemplary embodiment, the central plate 152 includes locking arms 188 extending forward from the central plate 152. The locking arms 188 are used to secure the locking block 156 to the central plate 152. The locking arms 188 may be deflectable.

The locking block 156 is configured to be coupled to the central plate 152 using the locking arms 188. In the illustrated embodiment, the locking block 156 includes an opening 190 passing therethrough. The opening 190 receives the locking arms 188. In an exemplary embodiment, the locking block 156 is secured to the outer frame 150 by a tether 192. The locking block 156 may be folded into the interior of the TPA device 112 to engage the locking arms 188 after the TPA device 112 is positioned in the housing 110. The locking block 156 includes locking edges 194 around a perimeter of the locking block 156. The locking edges 194 are configured to be positioned behind the latches 154 to stop the latches 154 from deflecting, and thus releasing the terminals 130, once the locking block 156 is locked in position to the central plate 152.

In an exemplary embodiment, the TPA device 112 is manufactured as a single piece. For example, the outer frame 150, the central plate 152, the latches 154 and the locking block 156 are integral as a unitary one piece body. The outer frame 150, the central plate 152, the latches 154 and the locking block 156 may be molded as a single piece body. Assembly of the TPA device 112 to the housing 110 may be made simpler by having a single piece structure loaded into the housing 110 as compared to a multi-piece assembly. However, in alternative embodiments, the TPA device 112 may include multiple components rather than a single piece.

Figure 7:
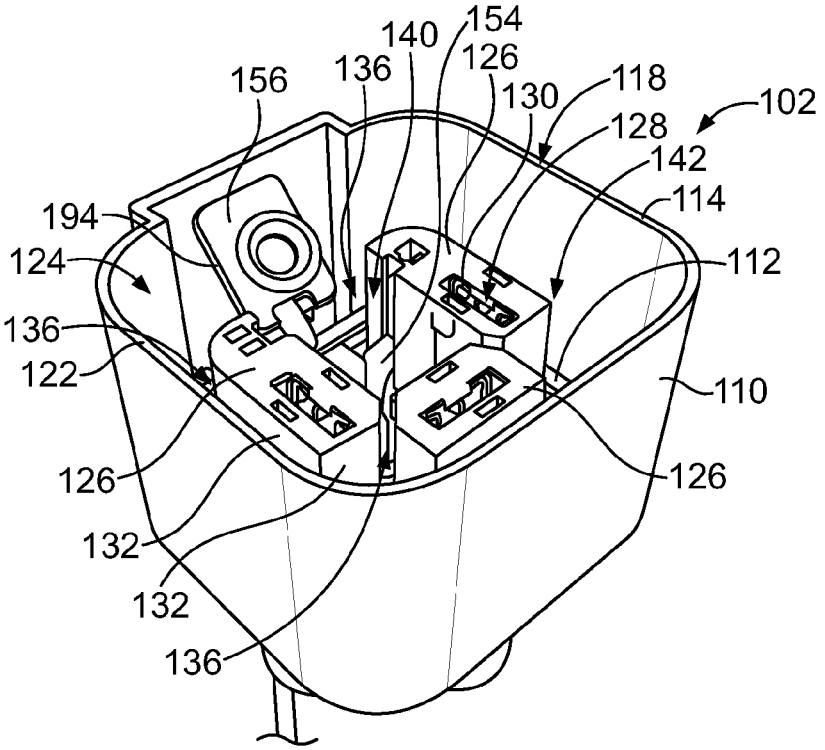
FIG. 7 is a perspective view of the electrical connector showing the TPA device loaded into a housing of the electrical connector.
Figure 8:
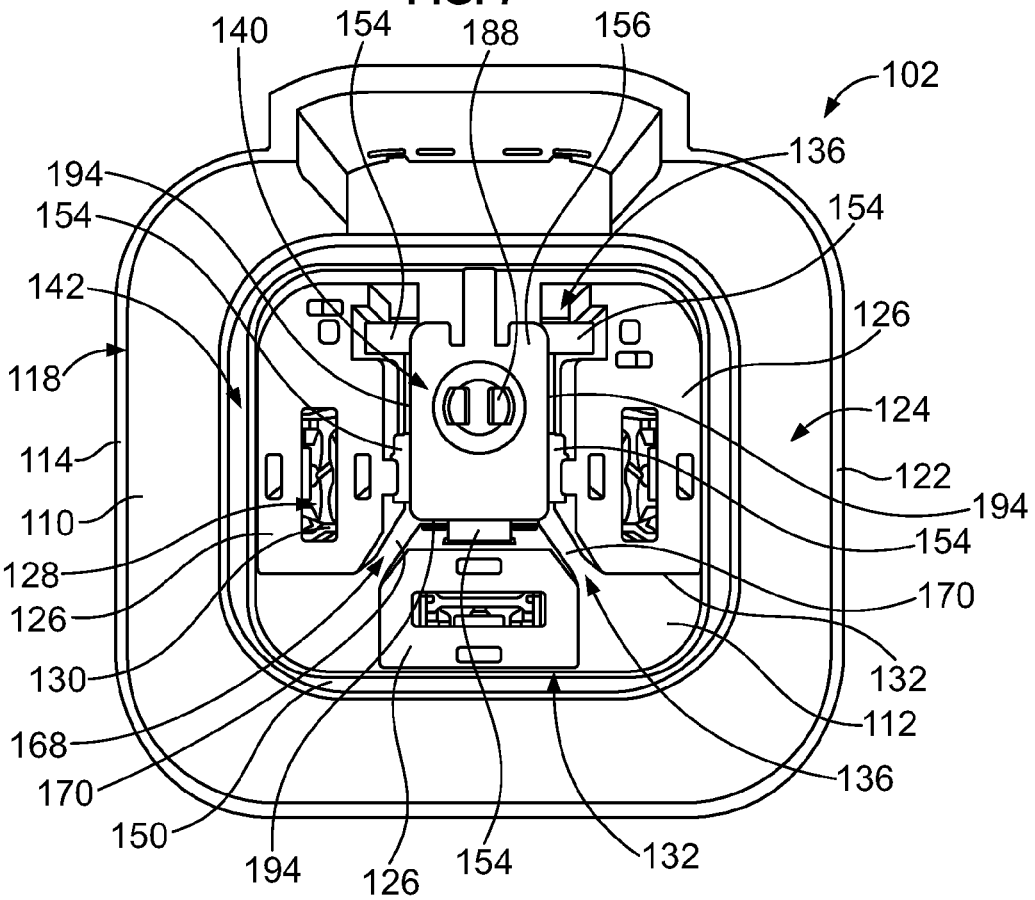
FIG. 8 is a front view of the electrical connector showing the TPA device in the housing.

FIG. 7 is a perspective view of the electrical connector 102 showing the TPA device 112 loaded into the housing 110. FIG. 8 is a front view of the electrical connector 102 showing the TPA device 112 in the housing 110. During assembly, the TPA device 112 is loaded through the mating end 118 at the front 114. The central plate 152 (shown in FIG. 6) of the TPA device 112 is received in the central cavity 140. The outer frame 150 and the perimeter seal 144 (shown in FIG. 2) of the TPA device 112 are received in the perimeter cavity 142. When the TPA device 112 is loaded into the chamber 124, the shroud 122 surrounds the outer frame 150. The outer frame 150 is positioned between the shroud 122 and the exterior surface 132 of the terminal towers 126. The terminal towers 126 pass through the central opening 168 in the outer frame 150. The straps 170 pass through the gaps 136 between the terminal towers 126 such that the central plate 152 is positioned interior of or between the various terminal towers 126, such as in the central cavity 140. The latches 154 extend from the central plate 152 into the terminal towers 126. The latching fingers 178 may be received in corresponding terminal channels 128. For example, the latching fingers 178 may be received in slots in the sides of the terminal towers 126 to enter the terminal channels 128 and interact with the terminals.

In an exemplary embodiment, the TPA device 112 is loaded into the housing 110 to a pre-stage position (FIG. 7). The housing 110 and the TPA device 112 may be shipped with the TPA device 112 in the pre-stage position. In the pre-stage position, the locking block 156 is unlocked, or uncoupled from the locking arms 188. Having the locking block 156 in the unlocked position, allows the latches 154 to be deflected, such as for loading the terminals 130 into the housing 110. For example, in the pre-stage position, as the terminals 130 are loaded into the terminal channels 128, the terminals 130 slide past the latches 154, which forces the latches 154 to deflect outward from the terminal channels 128. After the terminals 130 clear the latches 154, such as to fully loaded positions, the latches 154 may snap back to latching positions, wherein the latching fingers 178 are received in the terminal towers 126 and the terminal channels 128 to block the terminals 130 from removal from the terminal channels 128.

After the terminals 130 are fully loaded into the housing 110, the locking block 156 may be moved to a locked position (FIG. 8). The locking block 156 may be folded over to engage the locking arms 188. The latches 154 must be in latching positions to allow the locking block 156 to be moved to the locked position. For example, if one of the latches 154 were still deflected inward, such as because the terminal 130 were blocking the latch 154, the locking block 156 could not be moved to the locked position. The assembler would know that one of the terminals 130 was not fully loaded in such situation and would thus reassemble the terminals 130 to the fully loaded positions, at which time the latches 154 would all be in latching positions and provide clearance for the locking block 156 to move to the locked position.

In the locked position, the locking edges 194 are positioned immediately behind the latches 154. The locking edges 194 restrict movement of the latches 154 and thus hold the latches 154 in the terminal towers 126 in the blocking positions to block a shoulder or end of the terminals to ensure the terminals 130 are unable to be removed from the terminal channels 128. Optionally, the single locking block 156 may block all of the latches 154. Providing all of the latches 154 at the central location (e.g., the central cavity 140) allows the use of a single locking block 156 to block all of the latches 154. Having the latches 154 facing in different directions, such as in perpendicular directions, allows tighter spacing of the terminals 130 and terminal towers 126 in the central location, which may reduce the overall size of the electrical connector 102 in one or more dimensions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mating end at a front of the housing and a base at a rear of the housing, the housing having a plurality of terminal towers extending forward of the base toward the mating end, each terminal tower having a terminal channel therein configured to receive a corresponding terminal therein, the terminal towers being spaced apart from each other and surrounded by gaps, the gaps defining a central cavity between the plurality of terminal towers; and a terminal position assurance (TPA) device received in the central cavity, the TPA device being front loaded into the central cavity through the mating end in a loading direction toward the base, the TPA device including a plurality of latches received in corresponding terminal towers, the latches having latching fingers positionable in the corresponding terminal channels in blocking positions to block removal of the terminals from the terminal channels, the TPA device including a locking block received in the central cavity to lock the TPA device in the central cavity, the locking block being positioned relative to the latches to hold the latches in the blocking positions.

2. The electrical connector of claim 1, wherein the terminal channels extend along channel axes, the loading direction being parallel to the channel axes.

3. The electrical connector of claim 1, wherein the housing is mated to a mating connector at the mating end, the TPA device being loaded into the central cavity from the mating end.

4. The electrical connector of claim 1, wherein the TPA device includes a central plate, the central plate being loaded into the central cavity and positioned proximate to the base, the latches extending forward from the central plate.

5. The electrical connector of claim 1, wherein the TPA device includes an outer frame received in the housing around an outer perimeter of the terminal towers.

6. The electrical connector of claim 5, further comprising a perimeter seal captured between the outer frame and the base of the housing.

7. The electrical connector of claim 1, wherein the TPA device includes an outer frame defining a perimeter of the TPA device, the outer frame having a central opening, the TPA device having a central plate aligned with the central opening, the central plate connected to the outer frame by straps, the latches extending forward from the central plate, the central plate being received in the central cavity between the terminal towers, the outer frame extending around an outer perimeter of the terminal towers.

8. The electrical connector of claim 1, wherein the gaps define a perimeter cavity around a perimeter of the terminal towers, the TPA device including an outer frame received in the perimeter cavity.

9. The electrical connector of claim 1, wherein the housing comprises a shroud extending forward of the base and enclosing a chamber forward of the base, the terminal towers being positioned in the chamber and defining a perimeter cavity between the terminal towers and the shroud, the TPA device including an outer frame received in the perimeter cavity.

10. The electrical connector of claim 1, wherein the TPA device includes a central plate, the latches extending from and being integral with the central plate.

11. The electrical connector of claim 10, wherein the latches interact with the terminal towers on at least three sides of the central plate.

12. The electrical connector of claim 1, wherein the locking block is integral with the latches.

13. The electrical connector of claim 1, wherein the TPA device includes locking arms engaging the locking block to secure the locking block in position relative to the latches.

14. An electrical connector comprising:

a housing having a base at a rear of the housing and a shroud extending forward from the base to a mating end at a front of the housing, the shroud enclosing a chamber forward of the base, the housing having a plurality of terminal towers extending forward of the base into the chamber, each terminal tower having a terminal channel therein configured to receive a corresponding terminal therein, the terminal towers being spaced apart from each other and surrounded by gaps, the gaps defining a central cavity between the plurality of terminal towers, the gaps defining at least one perimeter cavity between the shroud and corresponding terminal towers; and a terminal position assurance (TPA) device received in the central cavity, the TPA device being front loaded into the central cavity through the mating end in a loading direction toward the base, the TPA device including an outer frame received in the at least one perimeter cavity between the shroud and the corresponding terminal towers, the TPA device including a plurality of latches received in corresponding terminal towers, the latches having latching fingers positionable in the corresponding terminal channels in blocking positions to block removal of the terminals from the terminal channels, the TPA device including a locking block received in the central cavity to lock the TPA device in the central cavity, the locking block being positioned relative to the latches to hold the latches in the blocking positions.

15. The electrical connector of claim 14, wherein the TPA device includes a central plate formed integral with the outer frame, the central plate being loaded into the central cavity and positioned proximate to the base, the latches extending forward from the central plate.

16. The electrical connector of claim 14, further comprising a perimeter seal captured between the outer frame and the base of the housing.

17. A terminal position assurance (TPA) device configured to be operably received in a central cavity of an electrical connector to lock terminals in the electrical connector, the TPA device comprising:

an outer frame defining a perimeter of the TPA device, the outer frame having a front and a rear, the outer frame having a central opening therethrough;

a central plate aligned with the central opening, the central plate being connected to the outer frame by straps;

a plurality of latches extending forward from the central plate, the latches being configured to be received in terminal towers holding the terminals, the latches having latching fingers configured to engage and block removal of the terminals; and a locking block coupled to the central plate, the locking block being positioned relative to the latches to hold the latches in blocking positions.

18. The TPA device of claim 17, further comprising a perimeter seal at the rear of the outer frame.

19. The TPA device of claim 17, wherein the outer frame, the central plate and the latches are co-molded as part of an integral, unitary one piece structure.

20. The TPA device of claim 19, wherein the locking block is co-molded with the outer frame, the central plate and the latches as part of the integral, unitary one piece structure.

* * * * *